United States Patent [19]

Rudkin

[11] 4,306,485

[45] Dec. 22, 1981

[54] MULTI-CHAMBERED HAND HELD PERCUSSION INSTRUMENT

[76] Inventor: Alan Rudkin, 832 Keene Rd., Largo, Fla. 33541

[21] Appl. No.: 135,434

[22] Filed: Mar. 31, 1980

[51] Int. Cl.[3] ..... G10D 13/08

[52] U.S. Cl. ..... 84/402; 46/193

[58] Field of Search ..... 46/191, 193; 84/402, 84/421, 327, 280 C; D17/22; D21/65; D56/1 R

[56] References Cited

U.S. PATENT DOCUMENTS

| | | | |
|---|---|---|---|
| D. 230,425 | 2/1974 | Rosen | D56/1 R |
| D. 244,635 | 6/1977 | Cohen | D17/22 |
| 2,318,460 | 5/1943 | Brief | 46/193 |
| 2,499,483 | 3/1950 | Foy | 46/193 |
| 4,165,671 | 8/1979 | Bose | 84/402 |
| 4,179,973 | 12/1979 | White | 84/402 |

FOREIGN PATENT DOCUMENTS

| | | | |
|---|---|---|---|
| 632958 | 11/1927 | France | 84/280 C |

OTHER PUBLICATIONS

The Torpedo, Latin Percussion, Inc., Jan. 7, 1975, Rogers Drums Catalog, 64R, p. 82.

*Primary Examiner*—L. T. Hix
*Assistant Examiner*—Alan Mathews
*Attorney, Agent, or Firm*—Ronald E. Smith

[57] ABSTRACT

A hand-held percussion instrument. A hollow, elongate cylindrical member has a plurality of musically-pleasing sound producing beads disposed therein, in free-flowing disposition so that oscillation or other movement of the member causes said beads to impinge upon the internal walls of the instrument, thereby producing said sound.

A pair of symmetrically positioned convex walls are juxtaposed mid-length of the instrument, interiorly thereof, and therefore define a bi-convex-shaped volume therebetween. A plurality of circumferentially spaced ports open the volume defined by the walls to atmosphere so that sounds generated by the impinging of said beads against said convex walls flows to the listener through said ports.

The instrument preferably has opposed frusto-conical ends and a support stand adapted to releasably engage either of said ends is provided.

5 Claims, 3 Drawing Figures

FIG. 1
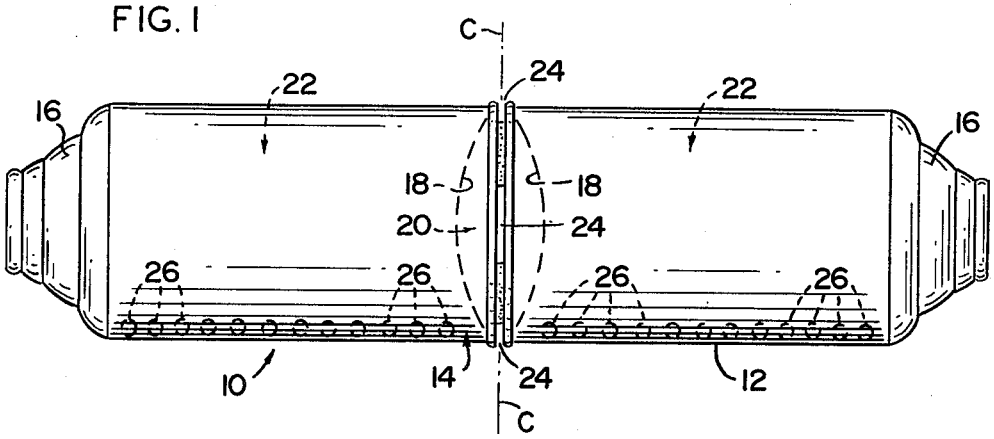
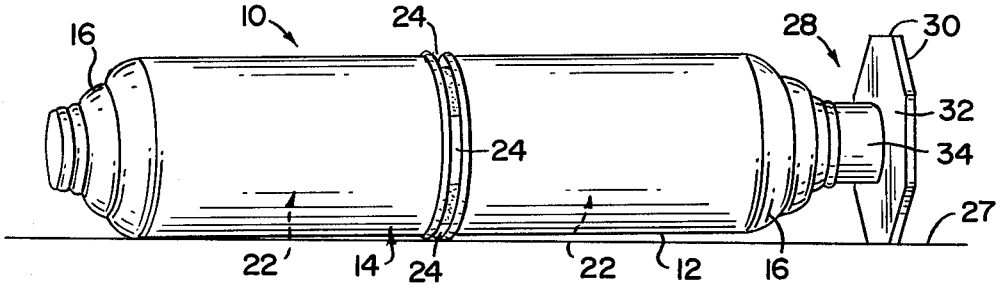
FIG. 2
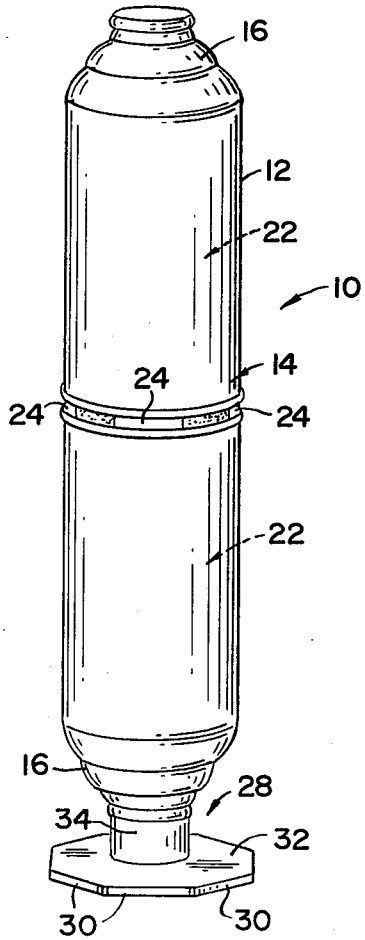
FIG. 3

MULTI-CHAMBERED HAND HELD PERCUSSION INSTRUMENT

BACKGROUND OF THE INVENTION

1. Field of the Invention

This invention relates generally to hand-held percussion instruments, more particularly to such instruments of the type having sound-generating balls or bead-like members disposed interiorly thereof in free-flowing disposition, and specifically to such an instrument having a tubular configuration with a volume substantially mid-length thereof defined by a pair of internal baffle wall members, said volume open to atmosphere through radially disposed ports formed about the periphery of said instrument.

2. Description of the Prior Art

The known hand-held percussion instruments have a single bead-containing chamber. Accordingly, when such an instrument of the prior art is oscillated axially, the beads must travel from one end of the instrument to the other in order to impinge upon the end walls of the instrument. Such lengthy travel time restricts the musical capabilities of the instrument and accordingly restricts the creative expression of the musician attempting to play such a device. Further, the known instruments, perhaps in part due to the provision of a single bead-containing chamber, produce insufficient levels of sound and thus require the musician to shake the instrument somewhat violently to generate the desired level of sound. Accordingly, the musician's physical energies are overtaxed, to the detriment of his or her creative energies.

SUMMARY OF THE INVENTION

A need is therefore seen to exist in the musical instrument industry for a hand-held percussion instrument that not only produces musically-pleasing sounds responsive to movement imparted thereto by a musician, but produces such sound without limiting the creative expression of the musician.

The longstanding but heretofore unfulfilled need for such an instrument is now fulfilled by an elongate, hollow, generally cylindrical instrument having frusto-conically-shaped opposing ends. The hollow interior of the instrument is subdivided by partition walls so that at least two inner chambers are provided. Each chamber is charged with free-flowing spherical bead members. A volume is defined between the two chambers, and ports are formed about the periphery of the cylindrical instrument to allow the escape of musically-pleasing sounds from said volume flanked by said chambers. The volume is preferably of bi-convex configuration. Thus, the partition walls comprise symetrically-positioned convex-in-configuration walls.

A stand having a graduate's cap appearance, generally, mates with either frusto-conically-shaped end so that the instrument can be supported in upstanding configuration, or restrained against rolling by the rectilinear-in-configuration base portion of said stand when the cylindrical instrument is laid on its side.

It is therefore seen to be an object of this invention to provide a hand-held percussion instrument that quickly responds to musician-imparted movement due to a shortened travel distance required to be traversed by the internally-disposed beads of such instrument.

Another object is to provide such an instrument that produces high levels of sound relative to the sound levels of earlier instruments while simultaneously providing an instrument that produces such higher levels of sound responsive to lower expenditures of energy by the musician playing such instrument.

Another object is to provide a support stand that permits the musician to deposit the inventive instrument on a support surface such as a table in either an upstanding or lateral disposition.

Still another object is to provide such an instrument that can be economically manufactured from commercially available items.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 1 is a side elevational view of the preferred embodiment of the invention, showing the internal convex-shaped partition walls in phantom lines.

FIG. 2 is a perspective view showing the preferred embodiment of the invention held in lateral disposition by the preferred support stand.

FIG. 3 is a perspective view showing the preferred embodiment of the invention held in upstanding disposition by the preferred support stand.

Similar reference numerals refer to similar parts throughout the several views of the drawings.

DETAILED DESCRIPTION OF THE PREFERRED EMBODIMENT

Referring now to FIG. 1, it will be seen that the preferred embodiment of the invention, generally designated 10, comprises a hollow tubular member 12 having an elongate medial portion 14 and longitudinally spaced opposing end walls 16,16 of generally frusto-conical configuration. Although the end walls 16,16 are preferably of frusto-conical configuration, planar end walls (not shown) could also be provided.

A pair of imperforate, symmetrically positioned, convex in configuration web-like chamber defining walls 18,18 are provided substantially mid-length of the elongate medial portion 14 of the instrument 10, interiorly thereof, and are depicted in phantom lines in FIG. 1. Due to the convex shape of the walls 18,18, such walls appear arcuate whether viewed in side elevation or plan view. The walls 18,18 lie in equi-spaced relation to the transverse centerline C of the instrument 10, on opposite sides thereof. It should be understood that the walls 18,18 collectively define a bi-convex configuration. Accordingly, a bi-convex shaped volume 20 is defined therebetween, and the hollow tubular member 12 is thereby partitioned into two inner chambers, collectively designated 22.

Although the tubular member 12 is preferably partitioned into two separate and distinct chambers 22,22, by a pair of baffle walls 18,18, it is clear that a single, generally planar wall (not shown) could also serve to so subdivide the hollow tubular member 12.

A plurality of radially disposed, or circumferentially spaced, openings or sound vents, collectively designated 24, provide fluid communication between the volume 20 and atmosphere.

Musically pleasing sounds are generated interiorly of the hollow instrument 10 by the impinging upon the inner walls of the medial portion 14 and upon the inner surfaces of the end walls 16,16, attendant reciprocating or oscillating motion imparted to said instrument 10 by a musician (not shown), by a plurality of generally spherical in configuration bead members, collectively designated 26. In the preferred embodiment of the invention, the chambers 22,22 are provided with a substantially equal number of beads 26.

When the instrument 10 is oscillated along its longitudinal axis, the presence of the walls 18,18 reduces the length of travel required for a given bead 26 to proceed from one end of either chamber 22,22 to the other. Thus, the instrument is more responsive to the musician's manipulation thereof than earlier such percussion instruments. Further, higher levels of sound, when measured in decibels, are attained due to the provision of the walls 18,18.

Due to the generally cylindrical shape of the instrument 10, a means should be provided to prevent it from rolling when laid on a planar support surface such as a table 27, as shown in FIG. 2. An octagonal planar base means 32 and a frusto-conical instrument receiving member 34 fixedly secured thereto substantially centrally thereof together define a support structure, or stand 28 for retaining said instrument 10 against movement when not in use. The flat edges 30 of the planar base member 32 prevent rolling motion of the instrument 10 when the same is laterally disposed.

FIG. 3 depicts the instrument 10 being held in upstanding configuration by the stand 28. Thus, it is seen that the stand 28, due to its specific construction, serves to hold the instrument in either of two dispositions.

It should be understood that the instrument 10 can be integrally formed, and that the hollow tubular member 12 could be subdivided into a plurality of chambers such as chambers 22,22.

However, the preferred method for constructing the instrument 10 is as follows. A pair of commercially available metallic cans (e.g., shaving cream cans, freon-containing cans, etc.) are placed in substantial axial alignment, and the convex-shaped bottoms of such cans are bonded together by suitable means at circumferentially spaced regions about the periphery thereof, so that a plurality of preferably four circumferentially spaced openings or sound vents are left between the can bottoms when the bonding operation is completed. The openings allow musically pleasing sounds to emanate substantially unmuffled and undistorted from the bi-convex-shaped volume defined by the juxtaposed bottom walls of said cans. Such commercially available cans are normally provided with frusto-conical shaped top ends, which ends are therefore insertable into and securable in the inventive support stand 28.

It will thus be seen that the objects set forth above, and those made apparent by the preceding description, are efficiently attained, and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention described herein, and all statements of the scope of the invention which as a matter of language might be said to fall therebetween.

Now that the invention has been described,

That which is claimed is:

1. A hand-held percussion instrument, comprising, a hollow tubular member having generally cylindrical sidewalls defining an elongate medial portion, said tubular member having longitudinally spaced transversely disposed end walls fixedly secured thereto at opposing ends thereof, said tubular member further having a pair of transversely disposed baffle wall members of generally convex shape arranged within said tubular member and extending diametrically thereof and having their respective marginal edges attached to said cylindrical side-walls, said baffle walls symetrically positioned relative to one another so that a bi-convex shaped volume is defined therebetween, and so that the hollow interior of said tubular member is partitioned into two separate and distinct chambers, said baffle walls spaced apart from one another a predetermined distance, a plurality of circumferentially spaced openings formed in said cylindrical sidewalls intermediate said baffle walls so that a volume defined between said baffle walls is in sound-transmitting fluid communication with the atmosphere, a plurality of bead members disposed interiorly of each of said internal chambers, in free-flowing relationship therein, whereby said beads impinge upon the inner cylindrical walls of said medial portion, upon said end walls, and upon opposite sides of said baffle walls thereby providing musically pleasing sounds responsive to musician-imparted motion of said instrument.

2. The instrument of claim 1, wherein said baffle walls and hence said circumferentially spaced openings are provided substantially mid length of said hollow tubular member.

3. The instrument of claim 2, wherein said end walls are generally frusto-conical in configuration, and wherein said end walls are collectively defined by a plurality of integrally formed, axially offset concentric ring members of progressively reduced diameters.

4. The instrument of claim 3, further comprising, a support means for said instrument, said support means including a flat, planar-in-configuration base member, said support means further including a cylindrical in configuration nesting means of predetermined diameter fixedly secured in upstanding relation to said base member, substantially centrally thereof, so that the upwardly opening open end of said cylindrical member is adapted to receive therein the one of said plurality of ring members that mates therewith, said predetermined diameter of said nesting means corresponding to the diameter of said one ring member.

5. The instrument of claim 4, wherein said base member has a peripheral boundary, and wherein at least a portion of said boundary is rectilinear in configuration to provide stability to said base member when said base member is disposed on a support surface in non-upstanding relation thereto.

* * * * *